US005284078A

United States Patent [19]

Hayes et al.

[11] Patent Number: 5,284,078

[45] Date of Patent: * Feb. 8, 1994

[54] CHAIN CUTTER

[75] Inventors: Richard D. Hayes, Edwardsville; Robert Schroeder; Dale A. Thorstens, both of Rockford; Larry L. Schumacher, Machesney Park, all of Ill.

[73] Assignee: Laclede Chain Manufacturing Company, St. Louis, Mo.

[ * ] Notice: The portion of the term of this patent subsequent to Nov. 24, 2009 has been disclaimed.

[21] Appl. No.: 937,520

[22] Filed: Aug. 28, 1992

Related U.S. Application Data

[63] Continuation-in-part of Ser. No. 723,931, Jul. 1, 1991, Pat. No. 5,165,316.

[51] Int. Cl.[5] ..... B26D 7/26

[52] U.S. Cl. ..... 83/582; 83/560; 83/646; 83/650; 83/829

[58] Field of Search ..... 83/743, 745, 829, 522.25, 83/650, 560, 582, 646; 211/59.2; 225/36

[56] References Cited

U.S. PATENT DOCUMENTS

| | | | |
|---|---|---|---|
| 2,253,094 | 8/1941 | Robbins et al. | 225/36 |
| 2,785,469 | 3/1957 | Vion | 83/397 |
| 3,565,139 | 2/1971 | Olson | 83/859 |
| 3,626,799 | 12/1971 | Gerber et al. | 83/132 |
| 4,058,150 | 11/1977 | Pennington | 83/862 X |
| 4,088,049 | 5/1978 | Benedict | 83/240 |
| 4,537,106 | 8/1985 | Rider | 83/650 |
| 4,919,384 | 4/1990 | Grimberg | 83/745 X |
| 4,979,411 | 12/1990 | Murasaki et al. | 83/156 |
| 5,165,316 | 11/1992 | Hayes | 83/650 X |

OTHER PUBLICATIONS

Three M Tool and Die Corp. Exhibit A and Attached Letter of Dec. 9, 1991.

*Primary Examiner*—Richard K. Seidel
*Assistant Examiner*—Kenneth E. Peterson
*Attorney, Agent, or Firm*—Kalish & Gilster

[57] ABSTRACT

A chain merchandising apparatus includes a frame, a cabinet secured to the frame, and chain support means mounted to the frame and located within the cabinet for supporting a plurality of chain containers. A chain cutter is moveably fixed to the apparatus so as to be facilely and safely selectively adjustable vertically and horizontally in relation thereto for permitting a user to position the chain cutter substantially adjacent to a preselected chain container supported on the chain support means.

10 Claims, 7 Drawing Sheets

CHAIN CUTTER

CROSS REFERENCE

This application is a continuation-in-part of U.S. patent application Ser. No. 07/723,931, filed Jul. 1, 1991, now U.S. Pat. No. 5,165,316.

FIELD OF THE INVENTION

This invention relates, in general, to the field of chain merchandising apparatuses and, more particularly, to an apparatus for merchandising chain which is provided with multiple adjustable shelves for receiving chain containers and further, having a selectively adjustable cutting mechanism attached thereto.

DESCRIPTION OF THE PRIOR ART

Consumers encounter a wide variety of situations requiring or facilitated by the use of chains. A few examples of these include suspending a child's swing, leashing a pet, anchoring a water heater or towing a vehicle. Each use may require a different type or weight of chain. The particular length of chain desired by the purchaser also varies widely. Accordingly, it is necessary for hardware stores and the like to provide many types of chain, preferably in bulk, so that the purchaser may select the desired length and style.

However, a number of concerns arise for the retailer who merchandises chain. For example, chain is inherently bulky and heavy. Therefore, a great deal of floor space is usually required to accommodate a significant selection of chain types and any apparatus used to hold chain in the store must be quite sturdy. Moreover, some method must be made available for cutting the chain desired by the customer and, in particular, cutting it to a preselected length. If a self-service system is provided, the area where the chain is displayed often becomes untidy and potentially hazardous as consumers in making their purchasing decisions pull out, examine and leave uncut lengths of various rejected styles of chains which subsequently become tangled in a heap upon the floor. This creates a safety hazard in terms of trip and fall accidents, a major concern in retail establishments such as hardware stores.

Further, it is desirable that there be some integral accommodation for drawing attention to the in-store location of the display and for providing information such as, for example, the brand of chain and/or the particular size of or use for the individual chain styles offered.

Heretofore, various open-sided, coverless display stands or racks have been provided for merchandising chain. For example, U.S. Pat. No. Des. 244,412 issued to Messenger illustrates a merchandise display rack which could be used for supporting spools of various sizes of chain. Messenger does not teach any type of measuring device or cutter or any means for preventing the merchandise displayed thereon from becoming dusty, tangled and generally untidy.

U.S. Pat. No. Des. 209,640 to Platky et al and U.S. Pat. No. Des. 217,701 to Schlueter each illustrate a combined display stand and cutter for chain or the like. In each case, the cutter is fixed at the floor level and the stand is open, somewhat flimsy and limited in use to providing spaces for only a few sizes or types of chain. Neither provides any method for covering the chain to prevent dust accumulation, nor is a significant amount of cabinet wall surface area available for providing information to the consumer.

Also, if the consumer is allowed to cut his or her own chain, some cutting mechanism therefor must necessarily be made available, preferably in such a manner that it does not present a hazard to small children who may be allowed to wander unattended throughout the store. The alternative is to require that all chain be cut by store personnel, resulting in increased costs and often either an extended wait or a lost customer. In either case, known chain merchandising apparatuses usually lack measuring means and thus cause some chain to be wasted as incorrect cuts are necessarily occasionally made.

Moreover, the chain cutter of the new chain merchandising apparatus is conveniently and safely structured in a manner previously unknown in the field of chain merchandising. For example, U.S. Pat. No. 4,537,106 which issued to Rider teaches an uncabineted display rack for open spools of chain and other filamentous materials. That rack is provided with a channel member mounted in front of the spools and having a cutting device, such as a pair of shears, secured thereto and located in a position for severing material extending through the channel. The channel member and a counting device are attached to a small rectangular plate for horizontal positioning as by sliding across the width of the spool rack. Unlike the present chain cutter, the severing device of the Rider patent is not adapted for smooth, horizontal, rolling movement, as well as being capable of substantially simultaneous facile vertical positioning.

Other prior patents disclose cutting devices which are adjustable in at least two directions for cutting planar or sheet-like materials. The cutter of the patent which issued to Murasaki et al, U.S. Pat. No. 4,979,411, is ultrasonic in nature and mounted on a holder so as to be electronically vertically positionable. The holder is mounted on a track and may be moved forward and back as well as side to side for working of an edge of laminated glass, such as is used in the automobile industry. The tracks or slides of Murasaki et al do not appear to be adapted with any particular type of bearing and the ultrasonic cutter is not facilely, manually adjustable, as is the new chain cutter.

U.S. Pat. Nos. 4,088,049 and 3,626,799 to Benedict and Gerber et al, respectively, each disclose cutting apparatuses for material which is provided in sheets. Although capable of forward and back, as well as lateral, horizontal movement, the mounting mechanism of each cutter varies substantially from that of the new cutter. In both prior cases the cutter is electronically operated. Some vertical positioning is also provided in each patent to permit the knife to be raised and lowered into and out of contact with the horizontally positioned sheet material.

Although the Benedict patent shows paired wheels mounted in a track for movement of the cutter, the structure is quite different from the present chain cutting device. No enclosure is provided for the wheels and no specific dimensions or bearing qualities are described. Benedict is also of interest as disclosing a brake to inhibit vertical movement of the cutter. The handle-operated brake includes engaging means which are adjustable thumb screws located so as to interact with vertical shafts. This sharply contrasts with the gum rubber portion which forms an exterior sleeve of sorts over the brake of the new chain cutter.

The cutter of U.S. Pat. No. 3,565,139, which issued to Olsen, is electronically controlled for cutting vertically positioned wood panels and can be adjusted vertically and horizontally. That cutter includes a rotatable turntable mounting mechanism and a counterbalance to control vertical movement. A latching mechanism is also disclosed and shown in FIG. 5 of the Olsen patent, which latching mechanism bears no structural similarity to the safety features of the present chain cutter.

An open display rack for chain having a cutter attached in such manner as to be positionable in the horizontal direction only has been known since December 1991 through the Three M Tool and Die Corp. and consists of a conventional chain cutter head mounted on a frame made moveable on wheels for left and right travel within an extruded metal trolley chassis in front of the chain rack. No provision for vertical movement of the cutter head is suggested thereby, nor are the various structural connections and safety features of the chain cutter of the new chain merchandising apparatus.

U.S. Pat. Nos. 2,785,469 and 529,285 to Vion and Mathers, respectively, disclose devices for measuring and cutting rope which is displayed on a merchandising apparatus of the open rack type. In both cases the cutting mechanism is fixed to the device in a position at shoulder level or higher.

Accordingly, there has been a long-felt need in the chain merchandising art for a chain cutter which is mounted on a chain merchandising apparatus in such manner as to be safely, selectively positionable in both the vertical and horizontal directions, and which can also be provided with a measuring device for accurate, unassisted dispensing of chain by the consumer. The present invention addresses this need by providing a chain cutter having the structural attachment, operation and safety features presently described and claimed for use with a chain merchandising apparatus.

Thus in the long history of chain merchandising very little has been done to update chain displays in the interest of safety, advertising, efficiency and overall appearance.

Accordingly, it is among the several objects of the present invention to provide an apparatus for merchandising chain in retail establishments so as to clearly and neatly display a varied selection of chain in a neat, safe manner using a minimal amount of floor space and reducing waste. It is intended that the apparatus be capable of holding various sizes of containers of chain and that such containers be supported on shelves which are easily filled, emptied and refilled.

It is further among the objects of the present invention that the apparatus having the above attributes also have an attached cutting mechanism which is facilely and safely adjustable vertically and horizontally and capable of being used by the consumer to measure a desired amount of chain and to separate that length from the source container thereof. The cutting assembly is intended to be provided with a braking mechanism to prevent free fall of a cutter head portion thereof.

It is also among the objects of the present invention having the above features that the apparatus provide a method to at least partially enclose the containers of chain displayed therein so as to keep them relatively free from dust and other debris and to provide a surface area for displaying advertising or other information regarding the chain contained therein. It is intended that the chain merchandising apparatus of the present invention be capable of being supplied to the retailer in a number of parts to facilitate shipping and storage and to enable the retailer to easily assemble the unit on site by use of only a few conventional hand tools, such as a screw driver and wrench.

Thus, in furtherance of the above objects, the present invention is, briefly, a chain cutting assembly for attachment to a chain merchandising apparatus. The chain cutting assembly is moveably fixed to the apparatus so as to be safely and selectively adjustable in relation to the merchandising apparatus in both the vertical and horizontal directions and includes a cutter head portion, a set of bars upon which the cutter head portion is moveably fixed and counterbalance means.

The present invention is also, briefly, a cam brake mechanism connected to the cutter head portion in such manner as to be moveable therewith and capable of selectively releasable automatic braking interaction with at least one of the bars upon which the cutter head portion is moveably fixed.

Moreover, the present invention is, briefly, the combination of a chain merchandising apparatus and the above chain cutting assembly, wherein the apparatus including a frame, a cabinet secured to the frame, and chain support means connected to the frame and located within the cabinet for supporting a plurality chain containers. The chain cutting assembly includes a horizontal support bar which is a channel section secured transversely to the cabinet substantially adjacent to the support surface, and the lower end of the vertical support bar is moveably coupled to the channel section by disk-shaped roller bearings rotatably connected to the lower end of the vertical support bar by receipt thereof within the channel portion of the channel section to facilitate selective horizontal adjustment of the chain cutter on the apparatus by causing the vertical support bar to be capable of facile rolling on the horizontal support bar. The disk-shaped roller bearings have a crowned outer edge to enhance rolling movement thereof within the channel portion of the channel section.

Other objects will be in part apparent and in part pointed out hereinbelow.

BRIEF DESCRIPTION OF THE DRAWINGS

Like parts are referred to by like reference characters throughout the various figures of the specification.

DESCRIPTION OF PREFERRED EMBODIMENTS OF THE INVENTION

Figure 1:
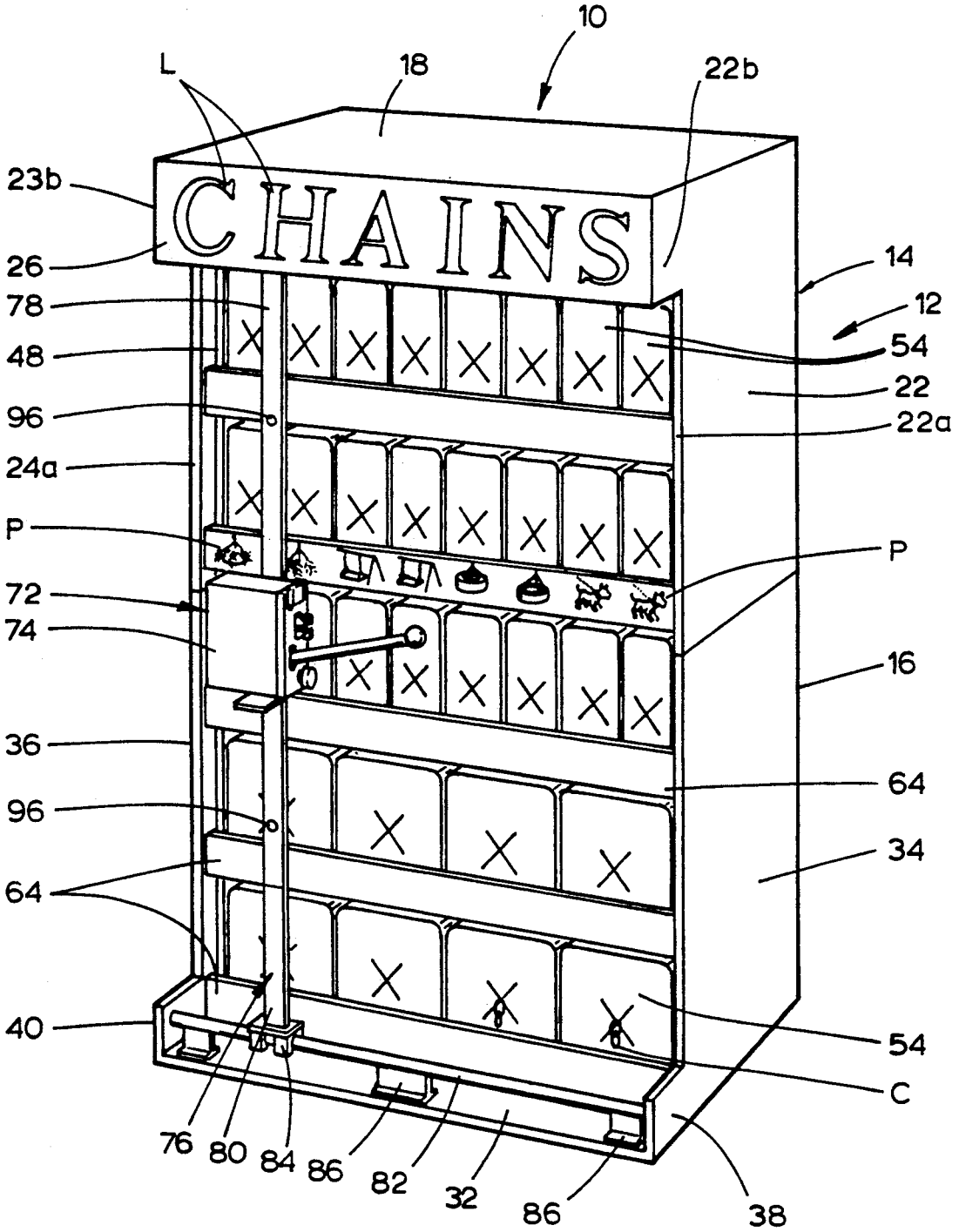
FIG. 1 is a front perspective view of a chain merchandising apparatus constructed in accordance with and embodying the present invention, showing schematically both unopened and opened boxes of chain supported therein, and further showing a first version of the chain cutter attached thereto.

Referring to the drawings, illustrated in FIGS. 1 through 6 and generally designated 10 is a chain merchandising apparatus embodying the present invention.

Figure 2:
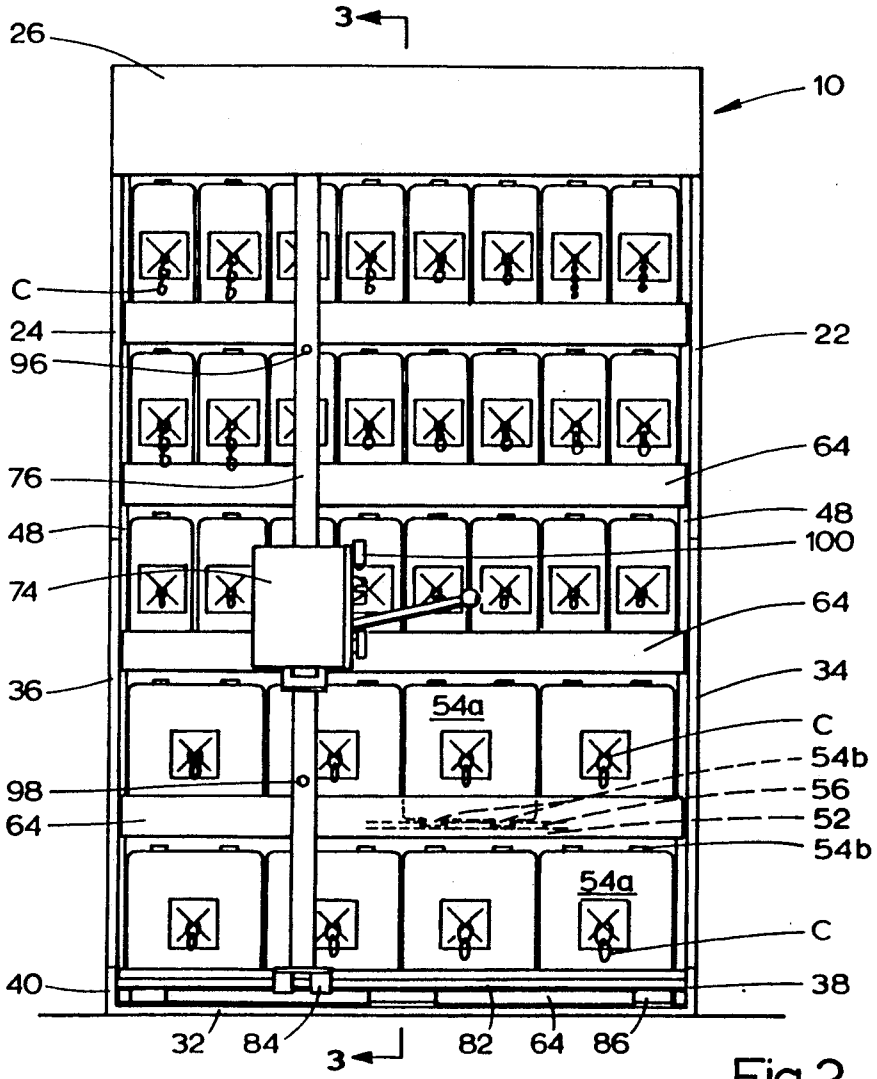
FIG. 2 is a front elevational view of the apparatus of FIG. 1 showing opened chain containers supported therein.
Figure 3:
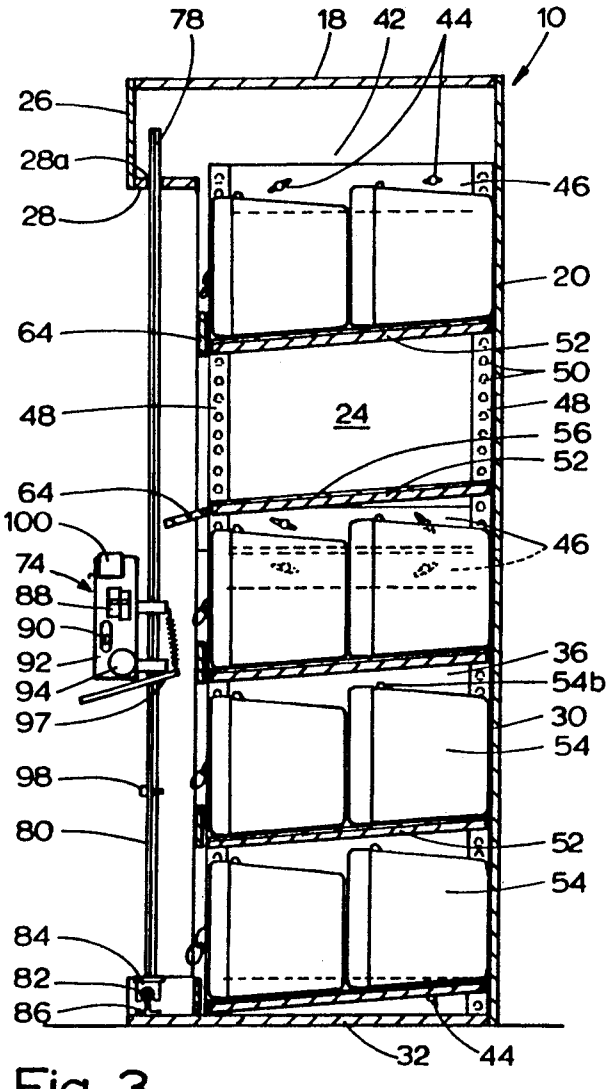
FIG. 3 is a right side section view taken on line 3—3 of FIG. 2.

FIGS. 1 through 3 illustrate that chain merchandising apparatus 10 includes a generally upright, box-shaped cabinet 12 having an upper portion 14 secured above a lower portion 16. Upper portion 14 includes a top panel 18 above a back panel 20 from which right and left side panels 22, 24, respectively, extend forwardly. Side panels 22, 23 terminate upwardly and forwardly in brow portions 22*b*, 23*b*, the latter connected by a front panel 26. Extending rearwardly from front panel 26 and parallel to and beneath top panel 18 is a narrow soffit panel 28 provided with a groove 28*a* formed along a longitudinal axis therethrough, and discussed further hereafter.

Lower cabinet portion 16 is provided with a back panel 30 connected at right angles to a bottom panel 32 from which right and left side panels 34, 36, respectively extend upwardly, each of the latter being provided with a forwardly projecting foot portion, 38, 40, respectively. Bottom panel 32 extends forwardly to terminate coextensively with optional side panel foot portions 38, 40.

Abutting (or intersecting) panel portions of cabinet 12, e.g. 20, 24, are securely attached to each other by known fastening means (not shown), such as screwing, bolting, and if desired, reinforced by gluing. It is preferred that each of the above cabinet 12 panels be provided to the retailer in separated form with pre-drilled holes and screws, such as dry wall screws (not shown) to facilitate assembly by the retailer on site. However, cabinet 12 could be shipped assembled, pre-attached to frame 42, or in separated units consisting of upper 12 and lower 16 cabinet portions.

FIG. 3 illustrates that cabinet 12 is preferably detachably connected outwardly to a frame 42, for example via known carriage bolt and wing nut assemblies 44 which connect side panels 22, 24, 34, 36 to horizontal frame members 46, which later are in turn connected by conventional fastening means such as screws or bolts (not shown) to elongated vertical frame members 48. It is preferred that horizontal frame members 46 be fabricated from wood, such as one-by-six boards, and that vertical frame support members 48 be of metal, such as standard hollow vertical shelving support bars having upturned tab-like flanges or brackets 50 spaced at regular intervals along the length thereof.

For sufficient strength and economy vertical frame members 48 are four in number and attached at or near opposing ends of horizontal frame support members 46; the latter being preferably eight in total number, two per cabinet 12 side panel 22, 24, 34, 36 and connected at inside upper and lower ends thereof. So constructed, frame 42 provides a strong, substantially rigid and stable skeleton upon which a skin in the form of cabinet 12 is supported. Of course other combinations of materials and numbers and placement of frame members 46, 48 are also conceived which will function appropriately.

Figure 4:
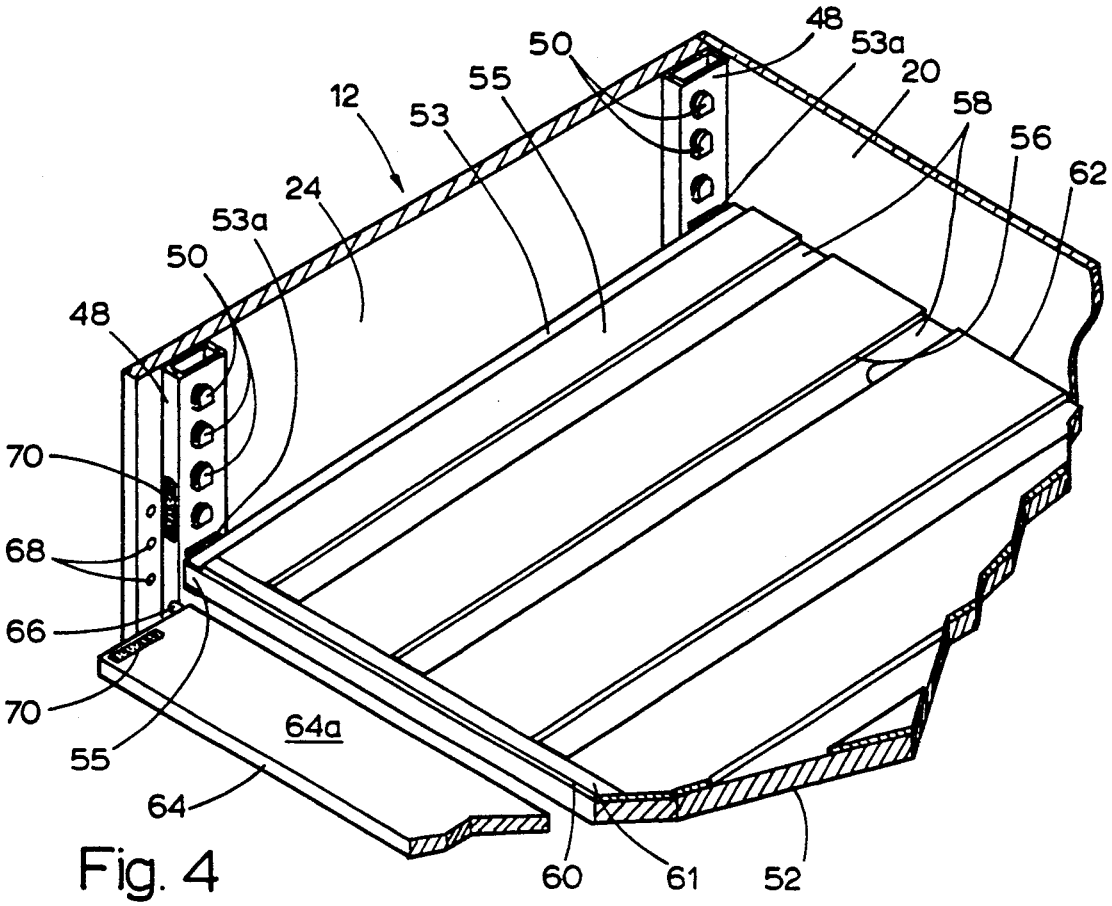
FIG. 4 is a partial breakaway view of the apparatus of FIG. 1 showing an empty open shelf with the front lip portion thereof in position for attachment thereto.

FIGS. 3 and 4 illustrate that supported by frame 42 within cabinet 12 are shelves 52 for supporting containers 54 of chain C. (Optionally, containers 54 may contain rope, hose, electrical wire or cable, not shown.) Shelves 52 are connected to vertical frame supports 48 by, for example, attachment of an elongated metal edge piece or channel-shaped sleeve 53 having a C-shaped cross section to each shelf end edge 55. Edge pieces 53 have preferably integral brackets 53*a*, as shown in FIG. 4, for connecting to upturned brackets 50 on vertical frame supports 48, as by merely hooking a bracket 53*a* over a preselected flange 50.

Shelves 52 are connected to vertical frame supports 48 at whatever height is required, according to the height of containers 54 to be supported thereon. If a container 54 having angled walls is used, as shown in FIG. 3, it is preferred that a back edge 62 of shelf 52 is connected to brackets 50 so as to be slightly higher than a front shelf edge 60 as by a distance of one bracket 50 length. So attached, shelf 52 slopes very gently forward, facilitating loading and unloading of containers 54 and permitting containers 54 to face the user substantially vertically for enhanced viewability. Because of the inherent weight of chain C within each container 54 there is little risk of at least a filled container 54 sliding forward on such a slopedly positioned shelf 52. This is the case even though containers 54 are provided in sizes small enough to be readily lifted for shelf stocking purposes. However, other features discussed hereafter further inhibit containers 54 from inadvertently shifting from their intended placement on shelves 52.

FIG. 4 illustrates the preferred method of constructing shelves 52 so as to be formed of wood, fiber board, particle board, or the like, overlayered with a thin sheet or laminate 56 of masonite or other material so as to define grooves 58 formed parallel to one another and extending approximately from front edge 60 approximately to back edge 62 of each shelf 52. Laminated layer 56 may be applied in separate strips of material preferably pre-stapled to shelf 52 prior to providing same to a chain retailer. When the preferred chain container 54 having a face 54*a* and tabs 54*b* formed adjacent thereto on container 54 (FIGS. 2, 3 and 5) is used in combination with chain merchandising apparatus 10, tabs 54*b* may be appropriately sized to fit into grooves 58, for accurate positioning of the heavy, awkward containers of chain on shelves 52. (Shown in phantom in FIG. 2). Grooves 58 terminate forwardly at transverse strip 61 which is applied to shelf 52 at the front edge 60 thereof. So placed, transverse strip 61 acts as a stop to further prevent container 54 from unintentionally sliding forwardly from shelf 52 by catching tabs 54*b* on container 54.

Grooves 58 can also be otherwise formed, as by saw cuts partially penetrating shelves 52, although the latter construction of horizontal shelves 52 may be weaker.

Of course, shelves 52 also function satisfactorily without the added feature of grooves 58.

Adjacent to front edge 60 of each shelf 52 is a horizontal slat 64, which appears lip-like in its upright normal display position, about four inches high at the front edge 60 of each corresponding shelf 52. Each slat 64 is preferably provided at opposed ends thereof with pegs 66 for insertion into holes 68 (FIG. 4) formed in side panels 22, 24, 34, 38 so as to permit slat 64 to be forwardly rotatable (shown in both closed and open positions in FIG. 3). Forward rotation of slat 64 may of course be accomplished by other means, for example by hinged attachment to shelf 52. The forward rotation of slat 64 to a flat, open position permits easy access to shelf 58 for loading and removal of containers 54 of chain C from a shelf 52.

FIG. 4 illustrates that slat 64 is maintained in a normally upright display position, for example by VELCRO strips 70 applied, as by gluing or other known methods, to an upper inner surface 64*a* of slat 64 and to frame upright member 48. Other conventional releasable attachment means, such as a hook and eye assembly (not shown) can also be used for this purpose and to provide greater securement of the upright position.

Figure 6:
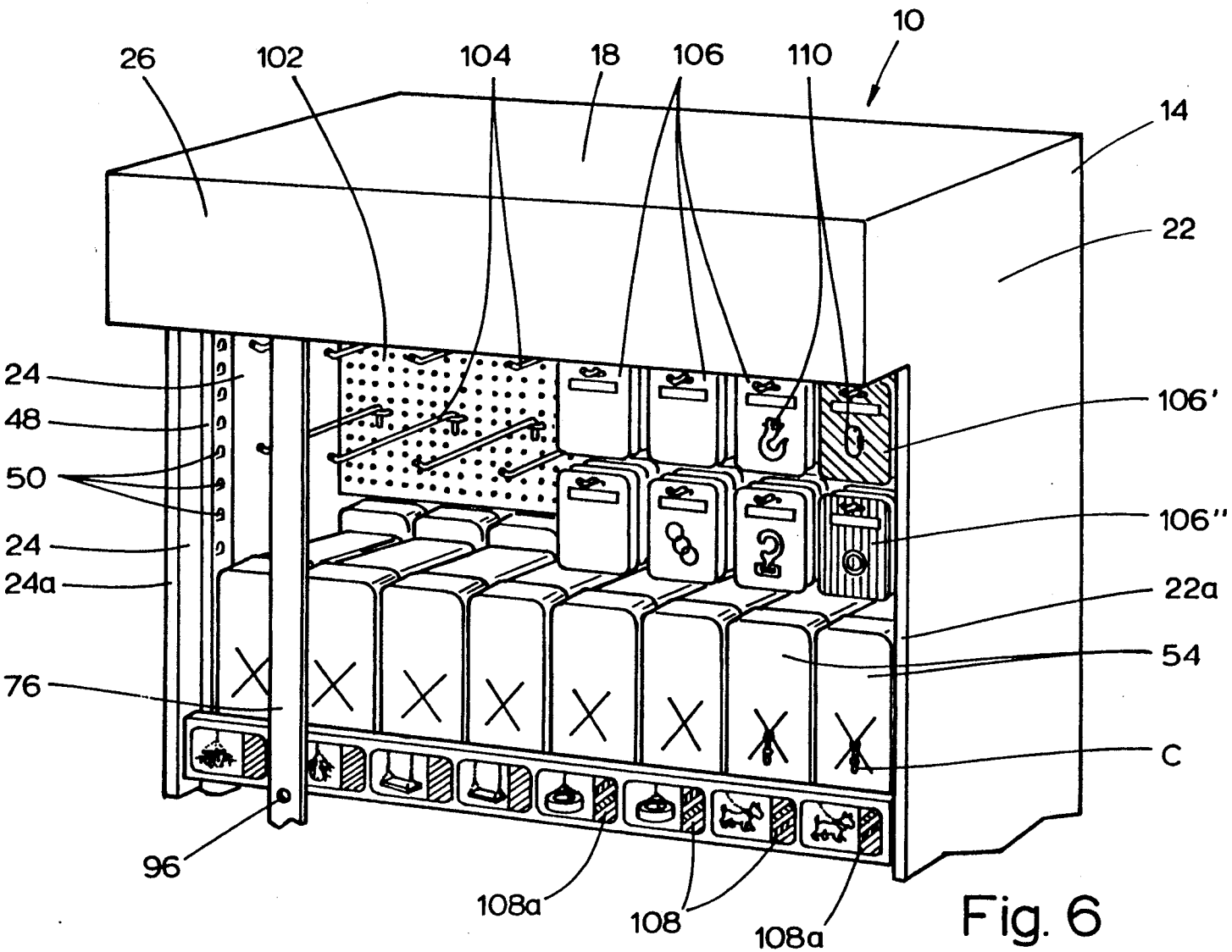
FIG. 6 is a partial breakaway view of the apparatus of FIG. 1 illustrating an adaptation thereof for simultaneous display of chain and chain accessories.

Front panel 26, side panels 22, 24, 34, 36 and shelf slat 64 all provide ideal surfaces for application of promotional or use information as by pictures P and letters L, shown as examples in FIGS. 1 and 6.

Figure 5:
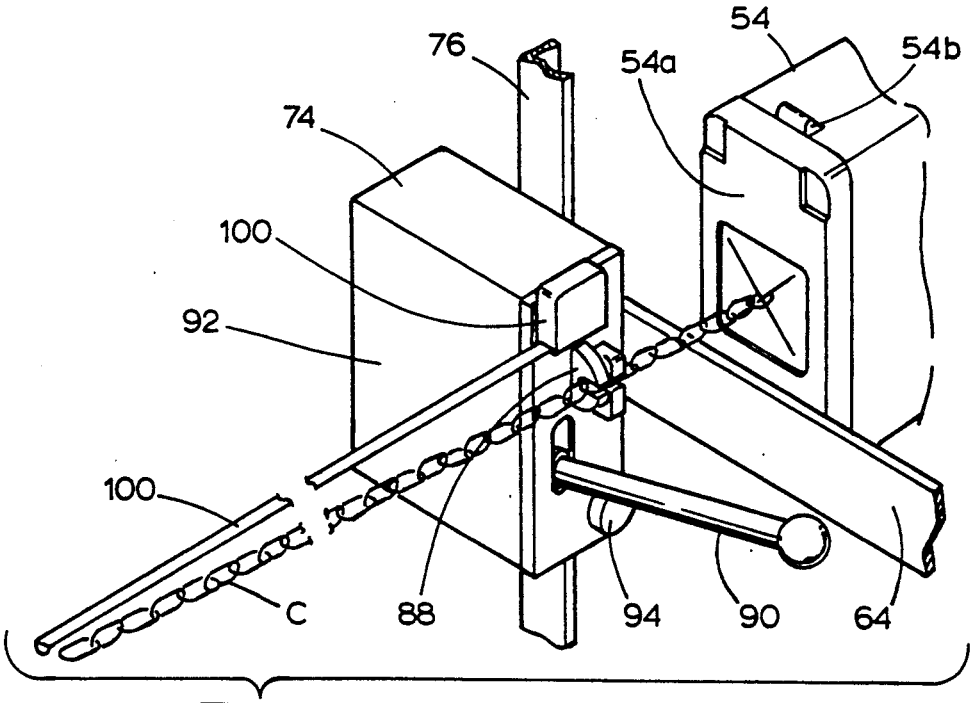
FIG. 5 is a partial breakaway view of the apparatus of FIG. 1 illustrating a chain in position for measurement and cutting.

Illustrated in FIGS. 1 through 3 and in more detail in FIG. 5 is one version of an adjustable cutting assembly 72 for cutting chain C. Cutting assembly 72 includes a head portion, generally designated 74, mounted on a vertical support bar 76 of angle iron having an upper end 78 slidably housed within groove 28*a* of soffit 28 (FIG. 3) and a lower end 80 moveably coupled to a horizontal support bar 82 as, for example, by roller bearing couplings 84, the horizontal support bar 82 being secured to cabinet base panel 32 as by flanges 86 and screws (not shown).

Cutter head 74 is preferably of a type commercially available, for example from tool and die companies, and includes at least a blade assembly 88 and a handle 90 for activating the hydraulic cutting mechanism (not shown) within housing 92 (FIG. 3); which hydraulic mechanism operates blade assembly 88. Alternatively, blade assembly 88 could be operated by mechanical, electrical or pneumatic means (not shown). An adjustment knob 94 and spring and lever assembly 96 permit vertical positioning of head portion 74 up and down on support bar 76 so as to permit the user to place the blade assembly 88 as adjacently close as possible to the face 54*a* of a preselected container 54 of chain C. Horizontal adjustment is provided by simply rolling the entire cutting assembly 72 right or left along horizontal support bar 82.

FIG. 3 illustrates a safety feature which is provided in part by apertures 96 formed through vertical support bar 76 at several locations along the length thereof. Apertures 96 can be penetrated by a heavy bolt 98 which the user is directed to place in the closest aperture 96 beneath head portion 74 when cutting assembly 72 is in a preselected cutting position. So placed, bolt 98 will prevent head assembly 74 from dropping entirely to the bottom of assembly 72, if for any reason spring and lever assembly 97 should fail. This added safety feature is important in that head assembly 74 weighs approximately twenty-five pounds and could cause serious damage to a user's foot if it should inadvertently happen to strike same. Other braking or stopping mechanisms may also be adapted for use with the described adjustable cutting assembly 72 to prevent such potential free-fall hazards.

A further safety feature is anticipated, but not shown, in adapting cutting assembly 72 for automatic return of head 74 to a height of at least five feet, to reduce access by children. For example, a hydraulic mechanism could be incorporated into or replace vertical support bar 76. In use of the embodiment shown, the customer can be directed to return cutter head 74 to its highest position after use for safety.

As a convenience to the user, head assembly 74 is provided with a tape measure 100, preferably mounted directly above or adjacent to blade assembly 88 for the most accurate possible measurement and cutting of preselected chain C. Tape measure 100 could, alternatively, be substantially enclosed within cutting assembly head 74. It is contemplated that known electronic scanning means (not shown) also be mounted on head 74 for providing automatic pricing of a desired chain purchase as such chain is measured and cut. Known digital analog display functions and UPC coding features could also be incorporated.

Figure 7:
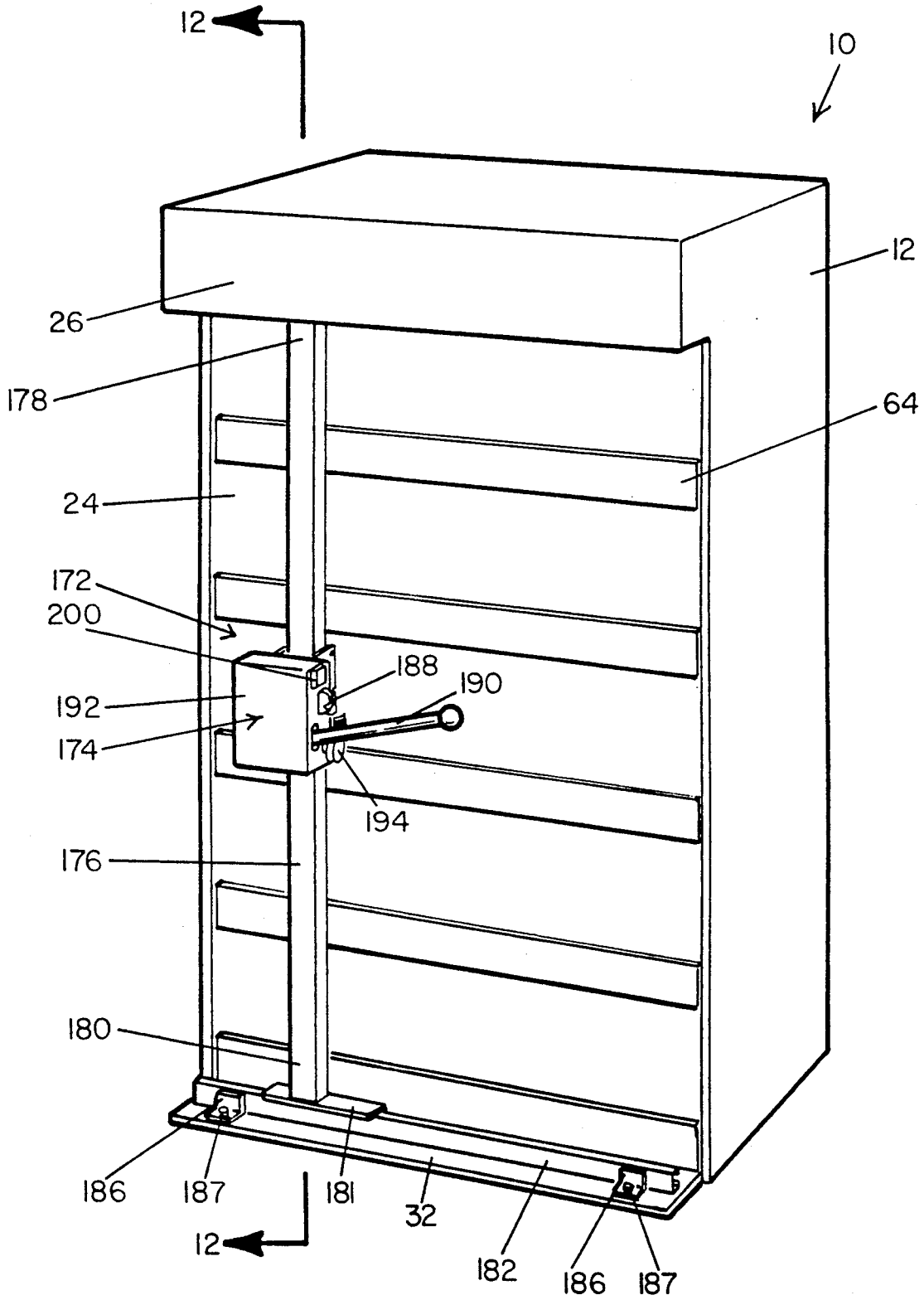
FIG. 7 is a front perspective view of a chain merchandising apparatus constructed in accordance with and embodying the present invention, the cabinet being shown schematically and without boxes, showing an alternative version of the chain cutter attached thereto.
Figures 8, 9:
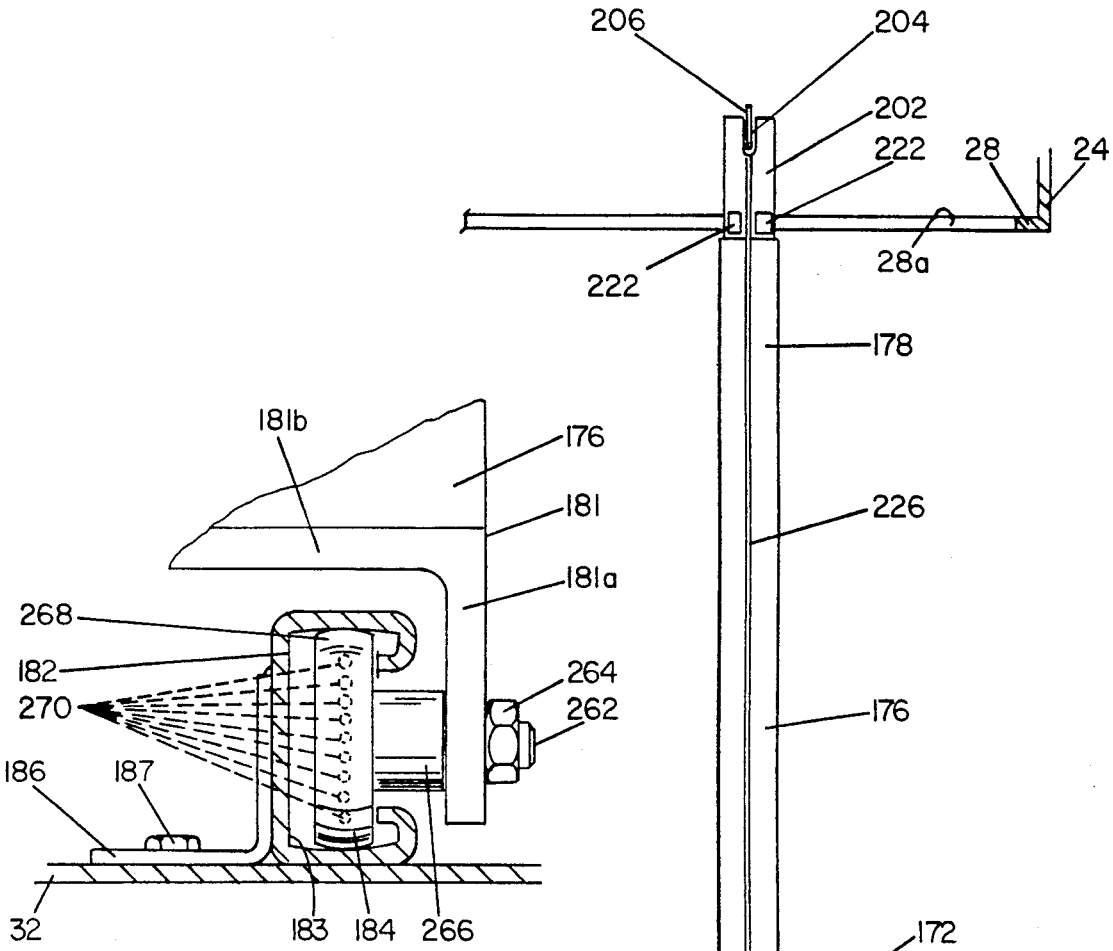
FIG. 8 is a rear elevational view of the chain cutter of FIG. 7 showing portions of the attached merchandising apparatus partially broken away.
FIG. 9 is an enlarged sectional view taken on line 9—9 of FIG. 8.

Illustrated in FIGS. 7 through 12 is a second version of an adjustable cutting assembly 172 for attachment to a chain merchandising apparatus such as that generally designated 10 (shown schematically here for simplicity and clarity of the drawings, but intended to be generally of the type previously described in detail) for cutting chain C. Cutting assembly 172 includes a head portion, generally designated 174, mounted on a vertical support bar or beam 176 preferably formed of approximately three inch square hollow, preferably metal, tubing having an upper end 178 slidably housed within groove 28*a* of soffit 28 (FIG. 12) and a lower end 180 fixed preferably by welding, perpendicularly to a section of angle iron 181 (approximately 9 to 10 inches long) which is in turn moveably coupled to a horizontal support bar 182 as, for example, by disk-shaped roller bearings 184 (shown in FIG. 9 and further explained hereafter), the horizontal support bar 182 being secured to cabinet base panel 32 as by flanges 186 and hex bolts 187 as shown in FIGS. 7 and 9.

Figure 12:
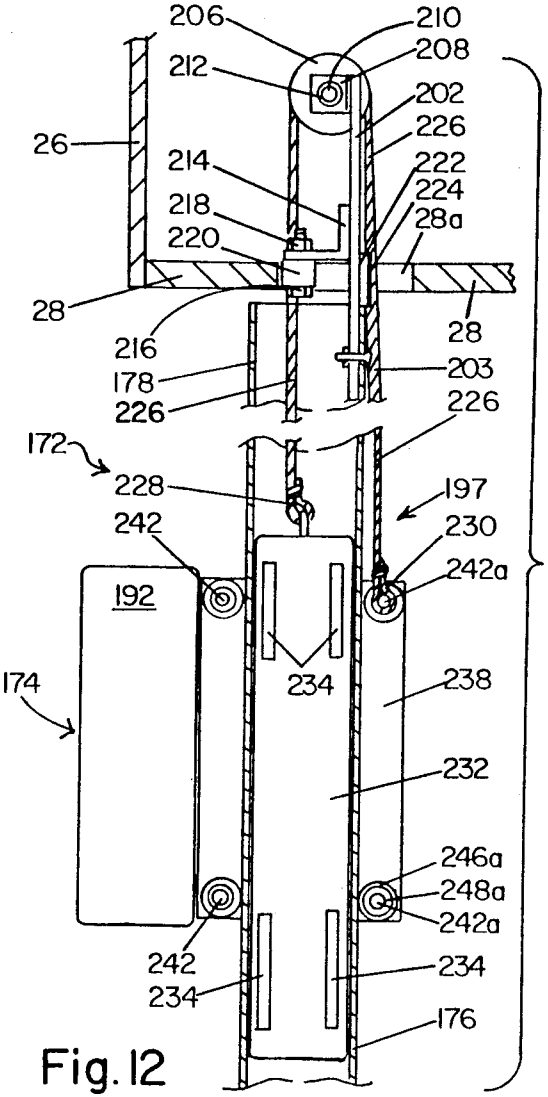
FIG. 12 is a partial sectional view taken on line 12—12 of FIG. 7.

FIGS. 8 and 12 illustrate that hollow beam 176 is desirably adapted at the rear of its upper end 178 with a flat plate-like extension, referred to hereafter as roller plate or counterweight roller plate 202. Roller plate 202 is preferably approximately 2.65 inches wide or otherwise sized so as to fit slidably within hollow beam 176 at upper end 178 thereof where roller plate 202 is connected, for example, by a button screw and nut arrangement 203 for optional dissembly and reassembly if necessary. The opposed end of roller plate 202 extends outwardly above vertical beam 176 and is provided with a longitudinal groove 204 (shown in FIG. 8) for receipt therein of a pulley 206.

Pulley 206 is rotatably connected to roller plate 204 by paired elbow brackets 208 mounted as, for example, by welding at opposed sides of groove 204 for receipt of opposed ends of pulley shaft 210, as shown in FIG. 12. Free rotation of pulley 206 is provided in part by mounting of bearings 212 (preferably "Boston" ball bearings) on opposed sides of pulley 206 on pulley shaft 210 inwardly of corresponding elbow brackets 208 and further secured thereto, if desired, for example by addition of conventional "E" rings as are commonly commercially available.

FIG. 12 illustrates that approximately midway along the length of counterweight pulley plate 202 and forwardly thereon is an elbow or "L" bracket 214 mounted (as by welding) beneath and to one side of pulley 206. L bracket 214 is penetrated on its horizontally positioned arm by a hex bolt 216 which is secured thereto by hex nut 218. Hex bolt 216 carries roller bearing 220 in a substantially vertical position for smooth horizontal movement of plate 202 within groove 28*a* of soffit 28. Fixed to the opposed side of roller plate 202, flush therewith and approximately opposite roller bearing 220 is a metal pad 222 preferably provided with a TEFLON coating or surface 224 to enhance sliding within groove 28*a*.

A preferably metal cable 226 (or other strong elongated filamentous material) rides in pulley 206 and extends between opposed ends 228 and 230. Cable end 228 is securely attached to an elongated weight 232 sized appropriately for longitudinally fitting and sliding within beam 176. Optional teflon strips or pads 234 are provided on all outer surfaces of weight 232 for enhancing and quieting sliding of weight 232 within hollow beam 176. The opposed cable end 230 is securely connected to cutter head assembly 174 as further described in detail hereafter. Accordingly, cable 226 connects cutter head 174 to counterbalance weight 232 to facilitate vertical movement of cutter head 174 outwardly upon beam 176 and also preventing free fall of the cutter head.

As illustrated in FIG. 7, cutter head 174 is preferably of a type commercially available, for example from tool and die companies, and includes at least a blade assembly 188 and a handle 190 for activating the hydraulic cutting mechanism (not shown) within housing 192; which hydraulic mechanism operates blade assembly 188. Alternatively, blade assembly 188 could be operated by mechanical, electrical or pneumatic means (not shown). For clarity of the drawings handle 190 has been omitted from FIG. 8, and FIGS. 10 through 12.

As in the prior embodiment, an adjustment knob 194 and a counterbalance assembly, generally designated 197, permit vertical positioning of cutter head portion 174 up and down on vertical support bar 176 so as to permit the user to place the blade assembly 188 as adjacently close as possible to the face 54*a* of a preselected container 54 of chain C. In order to easily accomplish this vertical movement cutter head 174 is attached outwardly and forwardly to beam 176 as described below.

Figure 10:
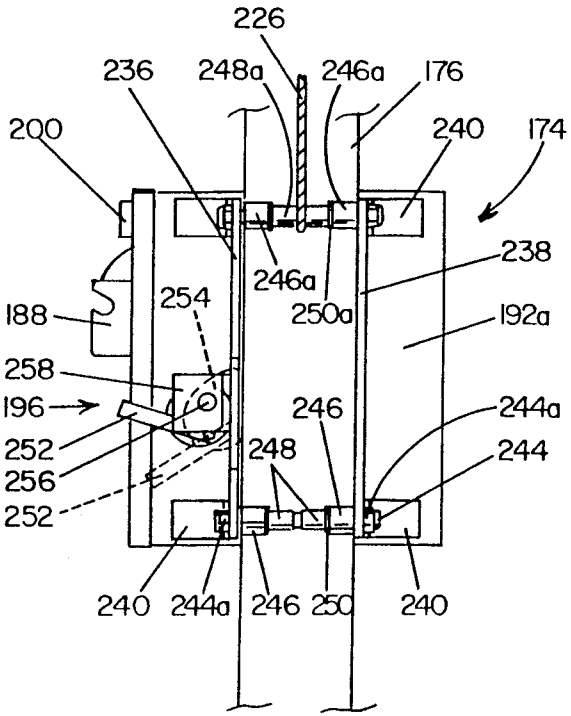
FIG. 10 is a partial enlarged rear view of the chain cutter of FIG. 7 without the handle and showing the braking mechanism in active and released positions.

Cutter head portion 174 is weldably connected to right hand and left hand roller plates 236, 238, respectively, as illustrated in FIG. 8, and FIGS. 10 through 12. In reference to FIG. 12, cutter head portion 174 is shown schematically with cabinet 192 as a blank box, for simplicity, rather than illustrating the internal components and external features thereof which have previously been discussed. Connection of roller plates 236, 238 to cutter head portion 174, is desirably accomplished by weldably attaching L brackets 240 to the back surface 192*a* of cutter housing 192 for a cutter head portion 174, as shown in FIG. 10. L brackets 240 are preferably positioned approximately at each of the four corners of surface 192*a* and spaced so that beam 176 may pass between opposed parallel outwardly projecting arms thereof. Such opposed outward projections of L brackets 240 are penetrated and connected to each other by shafts 242 (shown in cross section in FIG. 12) and hex bolts 244 which secure shafts 242 in position parallel to each other behind cutter head 174, forwardly of beam 176.

Internally of roller plates 236, 238 and mounted rotatably on shafts 242 are roller bearings 246 preferably separated by rotatable cylindrical spacers 248. If desired, spacers 248 may be separated from roller bearings 246 by washers 250, preferably of the style commonly referred to as snap rings.

Rearward corners of roller plates 236, 238 are likewise penetrated by identical shafts 242*a* which similarly are provided with inwardly rotatably mounted roller bearings 246*a*, snap rings 250*a* and rotatable spacers 248*a*. As shown in FIG. 12, the uppermost such shaft serves as an anchoring site for one end 230 of cable 226 which is securely attached thereto. So constructed, in movement of cutter head 274 vertically upon beam 176 roller bearings 246, 246*a* permit gliding contact with the outer front and back surfaces of beam 176 as counterbalance weight 232 makes corresponding opposed vertical movement within beam 176.

Figure 11:
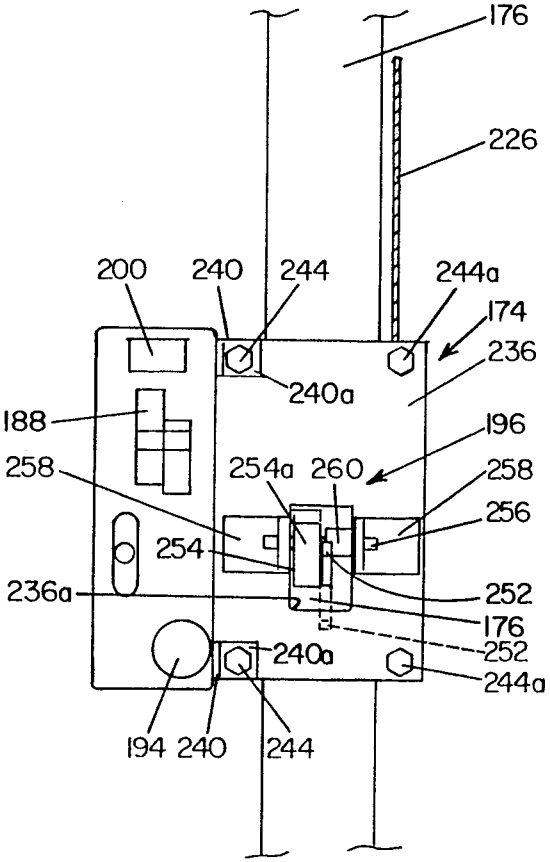
FIG. 11 is a partial user-right side enlarged view of the chain cutter shown in FIG. 10 to further illustrate the braking mechanism.

FIGS. 10 and 11 illustrate a safety feature which is provided by a brake, generally designated 196 for contacting vertical support bar 176 substantially at any location along the length of the user-right side thereof when head portion 174 is in a preselected cutting position. Brake 196 is intended to prevent cutter head portion 174 from suddenly dropping to the bottom of assembly 172, if for any reason counterbalance assembly 197 should fail, for example by disconnection of cable 226.

Brake mechanism 196 consists in part of a short stiff lever or handle 252 which is rigidly mounted perpendicularly to a flat side of a small cam 254. Cam 254 is pivotally mounted on cam shaft 256 between L brackets 258 which are in turn preferably weldably mounted to right hand roller plate 236 on each side of a desirably rectangular opening 236*a* formed therein (FIG. 11). Cam 254 is provided around the curved outer surface thereof with a sleeve 254*a* (FIG. 8) preferably formed of rubber or some other gripping material to enhance the braking function of cam 254. So constructed, brake mechanism 196 functions as shown in FIGS. 10 and 11. The brake-released position is illustrated in solid lines and is effected by manually moving handle 252 upwardly. Unless so moved, handle 252 assumes the downward (phantom) position to substantially automatically secure brake 196 against shaft 176 by forcing cam 254 and the rubber coating 254*a* thereon against beam 176 via opening 236*a* in right hand roller plate 236. Because of the cam construction of brake 196, the weight of cutter head portion 174 (approximately 25 pounds), when allowed to bear downwardly forces brake 196 ever tighter against beam 176, to thereby prevent free-fall of cutter head 174. If desired, a roller bearing such as that shown at 260 may also be journalled on shaft 256 for facilitating rotation of shaft 256 as cam 254 is moved against beam 176. Conceivably, other braking or stopping mechanisms may also be adapted for use with the described adjustable cutting assembly 172 to prevent potential free-fall hazards. For example, manual brake release handle 252 can be replaced with an electronic mechanism.

A further safety feature is anticipated, but not shown, in adapting cutting assembly 172 for automatic return of head 174 to a height of at least five feet from floor, to reduce access by children. For example, such a mechanism could be incorporated into or replace vertical support bar 176. In use of the embodiment shown, the customer can be directed to release brake handle 252 and gently urge cutter head 174 upwardly to return it to its highest position after use, for safety.

Horizontal adjustment is provided by simply rolling the entire cutting assembly 172 to the user's right or left along horizontal support bar 182 (preferably formed from a section of channel iron). This movement is facilitated by the specific structure hereafter described and shown in FIGS. 7, 8 and 9. Angle iron section 181, previously discussed, fixed at the lower end 180 of beam 176, is provided at each of its opposed ends with a generally disk-shaped bearing 184. Each bearing 184 is fixed to a centrally mounted perpendicular shaft 262 which penetrates through vertical wall 181*a* of angle iron 181 and is secured thereto by a jam nut 264. Between vertical angle iron wall 181*a* and bearing 184, optionally, beneath horizontal wall 181*b* of angle iron 181 is rotatably positioned a cylindrical spacer 266 upon shaft 262. Cutter assembly 172 is structured so as to be easily assembled for use in a retail store, preferably in such manner that bearings 184 slide into a track or channel 183 formed by horizontal support bar 182.

With reference to FIG. 9, each bearing 184, designed especially for use as described herein, is provided with a slightly domed or curved outer surface 268 to permit optimum movement with the least amount of friction possible within the channel of horizontal support bar 182. Furthermore, bearing 184 has an overall disk shape and is supported substantially vertically within channel 183 of horizontal support bar 182 such that a ring of internal ball bearings, indicated at 270 and shown in phantom in FIG. 9, appear to be vertical, or more or less parallel to vertical wall 181*a* of horizontally positioned angle iron piece 181 when bearings 184 are in place on assembled cutter 172.

To prevent cutter assembly 172 from being accidently rolled entirely off horizontal support bar (channel section) 182, the channel or track portion 183 may be provided at one end thereof with an internally welded stop bead 271 or unistrut nut assemblies 270 may be applied at each end of the track 182 to block the path of bearings 184. In any case, it is preferred to leave one end of horizontal support bar 182 unblocked to permit slidable entry of bearings, 184 during assembly. Thereafter a unistrut nut 270 may be applied to block the previously open end.

As in the first chain cutter version described above, cutter head portion 174 is also provided with a tape measure 200, preferably mounted directly above or adjacent to blade assembly 188 for the most accurate possible measurement and cutting of preselected chain C. Tape measure 200 could, alternatively, be substantially enclosed within cutting assembly head 174. It is also contemplated that known electronic scanning means (not shown) can be mounted on head 174 for providing automatic pricing of a desired chain purchase as such chain is measured and cut. Known digital analog display functions and UPC coding features could be incorporated as well. Also as in the previous version, other modifications can be made. For example, particular materials and types of connections may be substituted with acceptable results.

Returning to FIG. 6, there is illustrated a further adaptation of chain merchandising apparatus 10, wherein a peg board 102 is placed within cabinet 12 (shown here as preferred, within upper portion 14, although other placement will suffice). Peg board 102 is fixed within cabinet 12 by conventional means, such as screws or bolts, and may be situated adjacent back panel 20, but is preferred to be spaced somewhat forwardly thereof, for example so as to be approximately twelve inches from front edges 22*a*, 24*a* of panels 22, 24 and hung so as to be perpendicular to said walls 22, 24.

Suspended from peg board 102 are elongated hooks 104 for supporting chain accessory cards 106 which can be provided in various sizes for displaying chain accessories 110, such as those illustrated as examples in FIG. 6.

For the customer's convenience, it is preferred that accessory cards 106 be provided in various colors so as to be coded to match color bars 108 within color bar chain coding tags 108*a* (FIG. 6). Thus, by matching the background color of a card, for example cards 106' or 106" which would be provided in different colors (preferably from four to seven industry standard P.M.S. shades) to a matching color bar 108 on a product identification tag 108*a*, the consumer can determine whether a particular accessory will be adaptable or correspond to the chain C in a container 54 supported directly above that particular tag 108*a* on a shelf 52. If the background color of the selected accessory card 106 is not shown in one of the bars 108 of the tag 108*a* associated with the desired chain C, that particular accessory can not be expected to function properly with the preselected chain C. For the retailer's convenience, product information tags 108*a* may be applied to merchandising apparatus 10 as what is commonly known in the industry as channel tags along the front of slat or lip 64 directly in front of the corresponding container supported on the superiorly adjacent shelf 52.

Although the above embodiments are preferred, numerous variations are contemplated which also are satisfactory. For example, cabinet 12 may be formed of one piece, and, if desired, the entire unit may be rigidly fixed together and shipped as a unit, rather than in pieces. Moreover, apparatus 10 could be provided with a generally horizontal, rather than upright structure; although the illustrated form requires less floor space per display area. Also, support frame 42 could be affixed outward of cabinet 12 and still function satisfactorily, but the internal frame 42 structure shown is preferred as providing a cleaner appearance. Furthermore, to decrease shipping weight, back cabinet panels 20, 30 could be replaced by a single metal cross-brace. Of course apparatus 10 can also be used with chain containers 54 shaped quite differently than those shown, such as five-gallon plastic buckets, with adequate success.

When constructed as described and provided with the preferred overall dimensions of approximately four feet in width, six feet in height and two and one-half feet in depth, chain merchandising apparatus 10 easily accommodates thirty-two different sizes or styles of chain, cable or the like, with sufficient depth to permit storage of a second container of each type, as shown. The latter feature provides the merchandising advantages of facilitating shelf stocking and reducing the likelihood of "running out" of a particular type of chain in the midst of a particular customer's attempted purchase.

Accordingly it may be seen that the new chain merchandising apparatus provide many new and useful features to the art of chain retailing. Modern hardware stores require a neat, clean appearance, a safe, hazard free area and the ability to display a large selection of merchandise in an attractive, informative, safe manner. Chain merchandising apparatus 10 fulfills these needs while also being possessed of 1.) minimized shipping costs (from manufacturer to retailer; 2.) simplified, efficient assembly on site with little or no instruction; 3.) ease of use by adult consumers, even those who may be non-English speaking or not aware of safety requirements; and 4.) little or no product wastage.

In view of the foregoing, it will be seen that the several objects of the invention are achieved and other advantages are attained.

Although the foregoing includes a description of the best mode contemplated for carrying out the invention, various modifications are contemplated.

As various modifications could be made in the apparatus herein described and illustrated without departing from the scope of the invention, it is intended that all matter contained in the foregoing description or shown in the accompanying drawings shall be interpreted as illustrative rather than limiting.

What is claimed is:

1. A chain cutting assembly for attachment to a chain merchandising apparatus; said chain cutting assembly comprising:

a. a cutter head portion;

b. a set of bars upon which said cutter head portion is moveably fixed, at least one of said bars being fixed in relation to the chain merchandising apparatus so that said cutter head portion is selectively adjustable vertically and horizontally in relation to the merchandising apparatus for permitting a user to position said chain cutter head portion substantially adjacent to a preselected chain container on the chain merchandising apparatus; and c. counterbalance means connected to said cutter head portion to facilitate vertical movement thereof for safe, easy selective vertical adjustment of said cutter head portion.

2. The chain cutting assembly of claim 1, wherein one of said bars is a vertical support bar which extends between and terminates in opposed upper and lower ends, and said cutter head portion is mounted on said vertical support bar in such manner as to be safely and easily moveable between the upper and lower ends thereof.

3. The chain cutting assembly of claim 2, wherein another one of said bars is a horizontal support bar secured transversely to the chain merchandising apparatus substantially adjacent to a support surface therefor, and further wherein the upper end of said vertical support bar is connected to an upper portion of the chain merchandising apparatus in such manner as to permit slidable, horizontal adjustment in relation thereto, and the lower end of said vertical support bar is moveably coupled to said horizontal support bar, to thereby permit selective horizontal adjustment of said cutter head portion in relation to the chain merchandising apparatus.

4. The chain cutting assembly of claim 3, wherein said horizontal support bar is a section of channel iron secured transversely to said cabinet substantially adjacent to the support surface, and the lower end of said vertical support bar is moveably coupled to said horizontal support bar by weight-bearing roller bearing couplings within the channel of the channel iron to facilitate selective horizontal adjustment of said cutter head portion in relation to said chain merchandising apparatus by causing said vertical support bar to roll on said horizontal support bar.

5. The chain cutting apparatus of claim 1, wherein said set of bars includes a vertical support bar which is a hollow beam extending between and terminating in opposed upper and lower ends and upon which said cutter head portion is mounted so as to be selectively vertically adjustable; and further wherein the counterbalance means includes a pulley rotatably mounted at the upper end of said hollow beam, elongated, flexible connecting means extending between and terminating in first and second opposed ends and journalled on said pulley so as to be moveable thereon; a counterbalance weight of approximately equal weight as said cutter head portion, said counterbalance weight being secured to the first end of said elongated, flexible connecting means and being slidably housed within said hollow beam, the second end of said elongated, flexible connecting means being secured to said cutter head portion, to thereby provide said chain cutting assembly with a counterbalance means to offset the weight of said cutter head portion as it moves in a corresponding but opposite vertical direction on said hollow beam.

6. The chain merchandising apparatus of claim 2, wherein said chain cutting assembly further includes horizontal support means secured transversely to said cabinet substantially adjacent to the support surface, and a soffit having a horizontal groove, and further wherein the upper end of said vertical support bar is slidably housed within the horizontal groove of said soffit and the lower end of said vertical support bar is moveably coupled to said horizontal support means to thereby permit selective horizontal adjustment of said cutter head portion on said chain merchandising apparatus.

7. The chain merchandising apparatus of claim 6, wherein said horizontal support means is a channel section secured transversely to said cabinet substantially adjacent to the support surface, and the lower end of said vertical support bar is moveably coupled to said channel section by disk-shaped roller bearings rotatably connected to the lower end of said vertical support bar by receipt thereof within the channel portion of said channel section to facilitate selective horizontal adjustment of said chain cutting means on said apparatus by causing said vertical support bar to be capable of facile rolling on said horizontal support bar.

8. The chain merchandising apparatus of claim 7, wherein said disk-shaped roller bearings have a crowned outer edge to enhance rolling movement thereof within the channel portion of said channel section.

9. The chain merchandising apparatus of claim 8, and further comprising stop means connected with the channel portion of said channel section at each end thereof to thereby prevent inadvertent movement of said vertical support bar sufficiently far in a horizontal direction to cause said support bar to become detached from said chain cutter assembly.

10. The combination of a chain merchandising apparatus and a chain cutting assembly, wherein said chain merchandising apparatus comprises:

a. frame, b. a cabinet secured to said frame, c. adjustable chain container support means mounted to said frame and located within said cabinet, d. a plurality chain containers; and further wherein said chain cutting assembly comprises:

a. a cutter head portion;

b. a set of bars upon which said cutter head portion is moveably fixed, at least one of said bars being fixed in relation to the chain merchandising apparatus so that said cutter head portion is selectively adjustable vertically and horizontally in relation to the merchandising apparatus for permitting a user to position said chain cutter head portion substantially adjacent to a preselected chain container on the chain merchandising apparatus; and c. counterbalance means connected to said cutter head portion to facilitate vertical movement thereof for safe, easy selective vertical adjustment of said cutter head portion.

* * * * *